United States Patent [19]

Dolan

[11] Patent Number: 4,469,324

[45] Date of Patent: Sep. 4, 1984

[54] METHOD AND APPARATUS FOR INCREASING A SPRINTER'S SPEED

[76] Inventor: John O. Dolan, 2901 Barrow Pl., Midlothian, Va. 23113

[21] Appl. No.: 386,763

[22] Filed: Jun. 9, 1982

[51] Int. Cl.[3] ..... A63B 69/00

[52] U.S. Cl. ..... 272/70; 104/173 ST; 192/0.094

[58] Field of Search ..... 272/1 B, 3, 56.5 SS, 272/4, 70, DIG. 9, 118; 104/173 ST, 173 R; 242/107.3; 254/135, 199, 213, 224, 262, 274, 378, 903; 180/180; 280/809, 290, 292, 480; 60/905; 434/247, 253, 255

[56] References Cited

U.S. PATENT DOCUMENTS

| | | | |
|---|---|---|---|
| 353,089 | 11/1886 | Smith | 272/118 |
| 2,608,935 | 9/1952 | Moore et al. | 104/173 ST |
| 3,368,498 | 2/1968 | Doveri | 104/173 ST |
| 3,473,486 | 10/1969 | Harmon | 180/180 X |
| 3,739,728 | 6/1973 | Thompson | 104/173 ST |
| 4,309,862 | 1/1982 | Carlson | 192/0.094 X |

FOREIGN PATENT DOCUMENTS

| | | | |
|---|---|---|---|
| 158724 | 2/1954 | Australia | 272/4 |
| 900405 | 10/1944 | France | 104/173 ST |
| 1121039 | 4/1956 | France | 272/56.5 SS |
| 222226 | 10/1968 | U.S.S.R. | 272/70 |
| 766608 | 9/1980 | U.S.S.R. | 272/70 |

OTHER PUBLICATIONS

Ski Teach., Popular Mechanics, Jun. 1979, p. 90.

*Primary Examiner*—Robert A. Hafer
*Assistant Examiner*—Arnold W. Kramer
*Attorney, Agent, or Firm*—Cushman, Darby & Cushman

[57] ABSTRACT

A motorized reel is mounted at a fixed location and constructed and arranged to reel-in a lead rope having a runner-connector at its free end. A set of controls including a throttle and a brake is provided at the fixed location for reeling-in the runner at a controllable speed which, typically, is at least slightly faster than the runner is used to running when unaided. Just ahead of the runner-connector on the lead rope is a kill-switch actuator for closing a kill switch and thus terminating the reeling-in action as the runner nears the fixed location. The runner connector is a ring and pulley with a short length of secondary rope looped around the pulley sheave and provided with hand grips at its opposite ends so that normal alternating pumping action of the runner's arms is accommodated by left-right oscillation of the secondary rope along the pulley sheave.

8 Claims, 5 Drawing Figures

METHOD AND APPARATUS FOR INCREASING A SPRINTER'S SPEED

BACKGROUND OF THE INVENTION

When running for sport, humans generally split into three categories: endurance over relatively long distances, speed over relatively short distances, and personal pleasure without concern for distance or speed. It is with the middle category of runners that the present invention is particularly concerned, a category of persons which is hereinafter sometimes termed "speed runners".

Many techniques are used by speed runners and their coaches for increasing running speed. Typically each technique which has utility is capable of producing a modest increase in speed, whereupon another plateau is reached. For instance, a speed runner who runs alone and without a timer usually is able to run the same course faster in competition with at least one other runner or with the aid of a timer. Once a plateau is reached some additional gain may still be made by modifying these aids, for instance by switching to a faster running partner or giving the runner altered time cues. Frequency, duration and content of practice and competition, diet, life style modification, running surface, climate and weather, shoes, clothing and coach/runner interfacing all may contribute to running speed improvement.

Beyond these known "carrot"-type techniques for increasing running speed are known "stick"-type techniques for inducing further improvement in a more direct manner. Principal among these, are the known techniques of fastening one end of a rope to a motor vehicle such as a car or motorcycle and the other end to the runner, and operating the motor vehicle over the selected course at a speed which is somewhat faster than the runner can run unaided. Provided the runner is not pulled too much faster than he or she can run, the result may be to induce a rather permanent increase in the runner's speed capability, due to the runner's forced adoption and then assimilation of changed body motion and techniques. however, these known techniques for improvement by direct application of pulling force can be dangerous to carry-out; the attention of the motor vehicle driver is divided between the course and the runner. As a result, the runner may all too easily become accidentally injured. Thus some speed runners who have exhausted or reached plateaus from using the indirect techniques for increasing their running speed, are prevented by their own or someone else's perception of undue risk from using known techniques for direct application of pulling force for further increasing their running speed. Yet the temptation to flirt with danger for the possible reward from using the known techniques never goes completely away.

SUMMARY OF THE INVENTION

It is an object of the invention to provide a method and apparatus for applying pulling force directly to a speed runner in a more effective, more controllable and inherently less hazardous manner than has heretofore been conventional.

A motorized reel is mounted at a fixed location and constructed and arranged to reel-in a lead rope having a runner-connector at its free end. A set of controls including a throttle and a brake is provided at the fixed location for reeling-in the runner at a controllable speed which, typically, is at least slightly faster than the runner is used-to running when unaided. Just ahead of the runner-connector on the lead rope is a kill-switch actuator for closing a kill switch and thus terminating the reeling-in action as the runner nears the fixed location.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1:
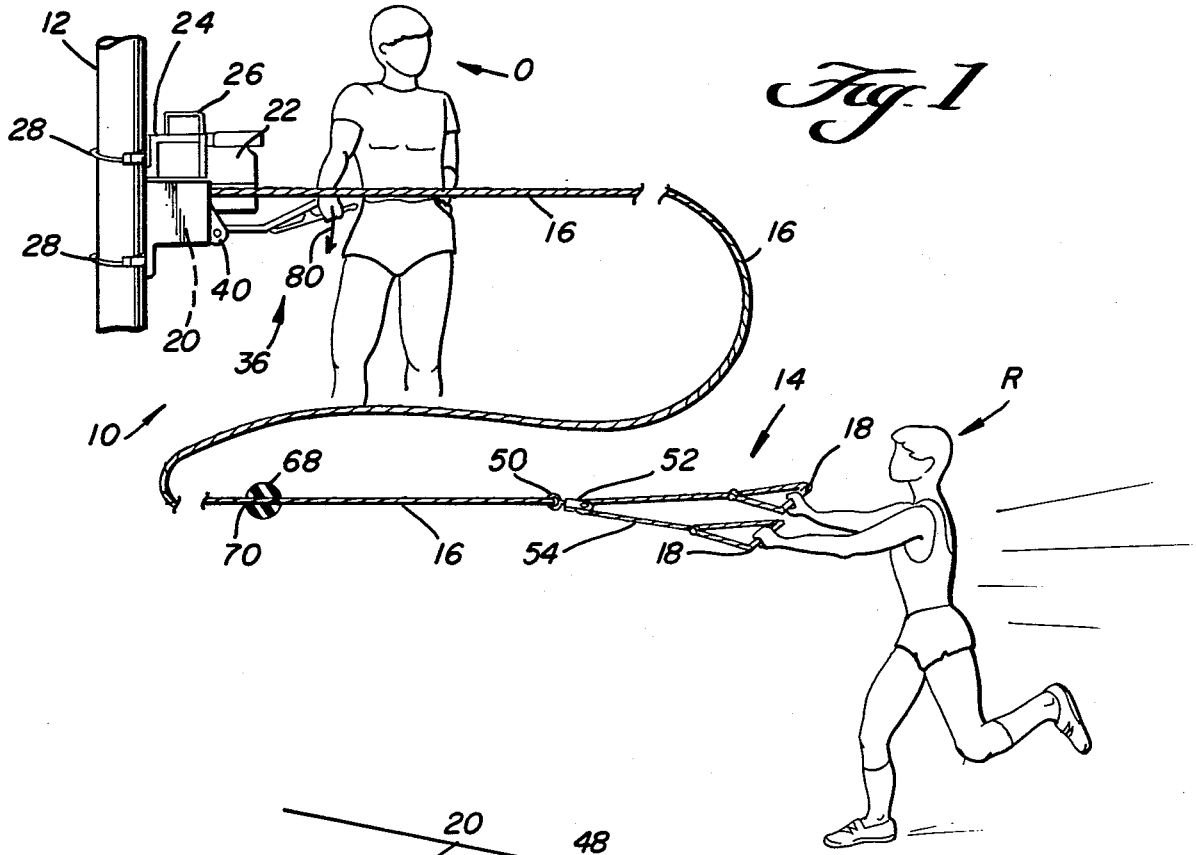
FIG. 1 is a perspective view of a runner being reeled-in using apparatus for increasing the runner's sprinting speed in accordance with principles of the present invention.
Figure 2:
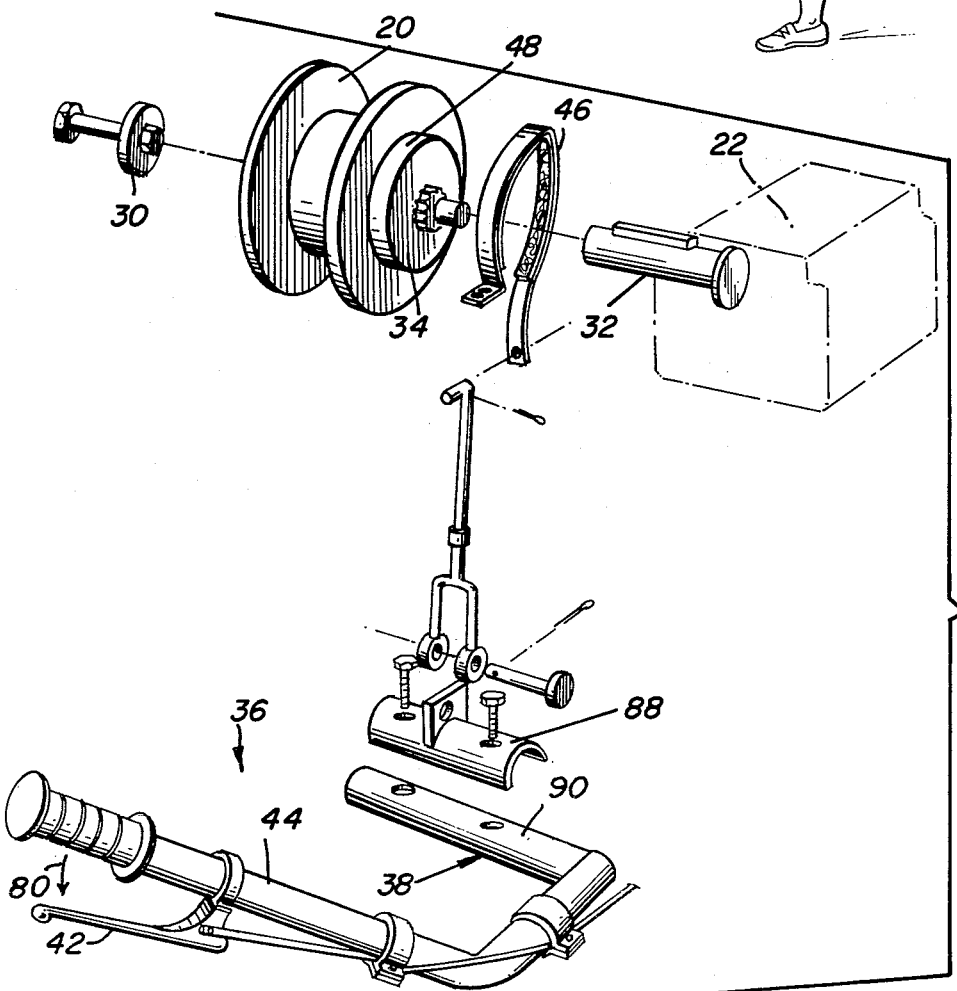
FIG. 2 is an exploded perspective view on a larger scale of a first portion of the apparatus shown in FIG. 1.
Figure 3:
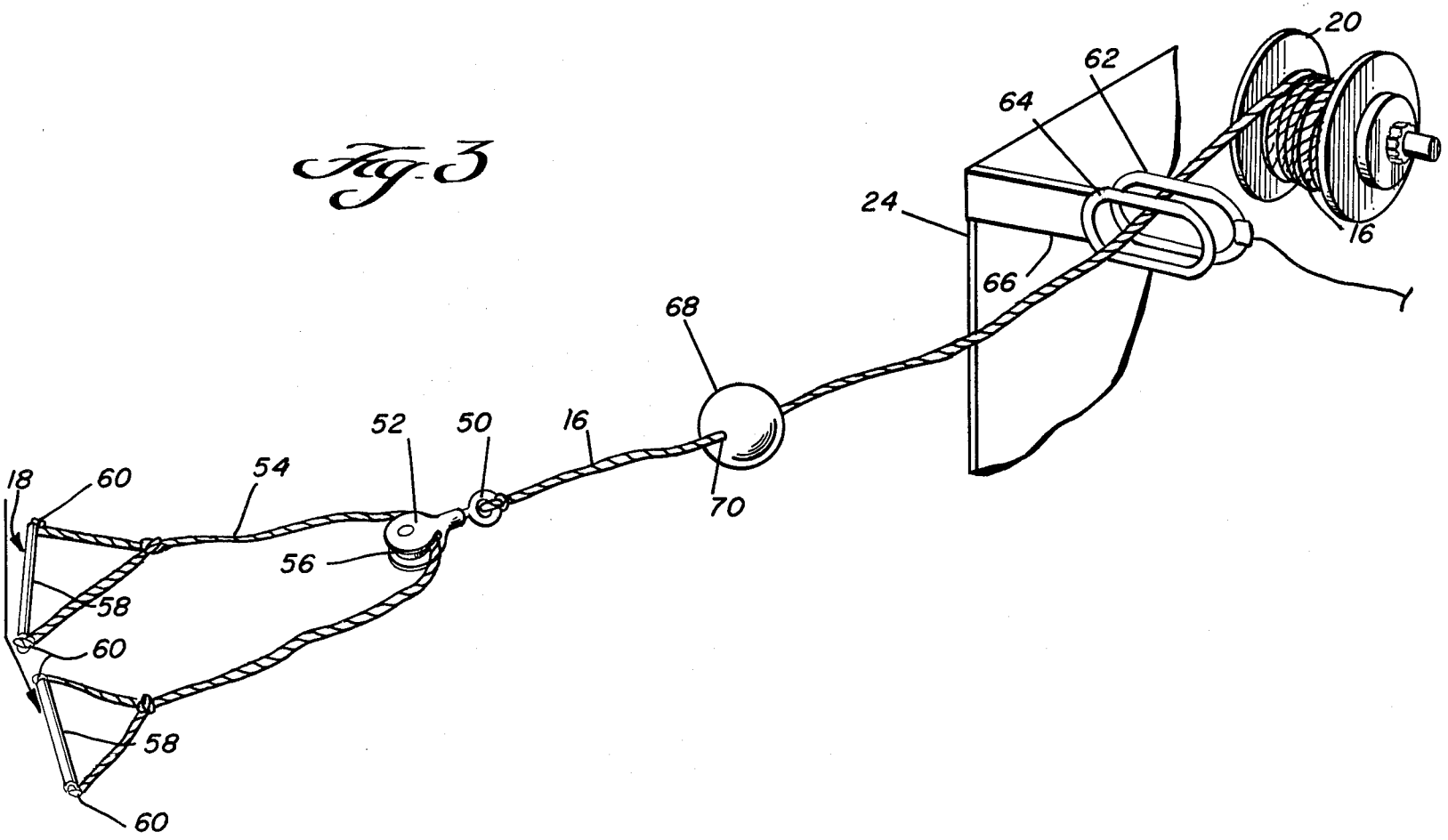
FIG. 3 is an exploded perspective view on the same scale as FIG. 2 showing a second portion of the apparatus.

In FIG. 1 a preferred embodiment of the apparatus 10 is shown in use. In this instance, the apparatus 10 has been mounted at a fixed location, for instance to the vertical portion 12 of the standard of a now-conventional football goal post unit. Any other fixed mounting means such as a pole or post or the like would suffice.

The device 10 is shown being run by an operator O to reel-in a sprinting runner R at a speed that is at least at times at least slightly faster than the maximum speed which the runner is accustomed to running freely. To this end, the runner is connected to the free end 14 of a tow rope 16, e.g. by handholds 18, the opposite end of the tow rope 16 being connected to a winding-in reel 20 which is powered by a motor 22 that is operated by the operator O.

Now, looking at the preferred embodiment in more detail, the device 10 is seen to include a frame 24 having carrying handles 26 and having attached U-bolt clamps 28 by which the frame 24 may be removably yet fixedly secured to any suitable support, such as an upright fixed post 12.

Also mounted on the frame 24 are the motor 22, and the spool or reel 20, which is journalled by bearing means 30 for rotation. The reel 20 is positioned and journalled to be driven from the output shaft 32 of the motor 22, via a conventional centrifugal clutch 34.

Further, the device 10 includes a control station 36. It is shown comprising an L-shaped joy stick 38 pivotally journalled on the frame at 40 and including both a motor throttle control 42 on its handle 44 and a brake band loop 46 secured to its body and operatively entrained about the drum 48 of the centrifugal clutch 34.

By preference, the motor 22 is a 5 h.p. gasoline-driven engine, e.g. of a kind that is conventionally used for powering lawn mowers. Similarly, the motor throttle control 42 may be of the squeeze lever kind conventionally used for controlling such lawn mower engines. The centrifugal clutch 34 is so adjusted that when the motor 22 is running at idle, the clutch provides no output torque. However, as the throttle control lever 42 is squeezed toward the handle 44, the motor 22 speeds-up causing the clutch 34 to engage and provide output torque for correspondingly rotating the reel 20.

The motor 22 is connected via the centrifugal clutch 34 to the reel 20, in the sense which causes the reel to rotate to wind-in a tow rope 16. The rope 16 has one end secured to the reel and the other, free end provided with means by which the tow rope may be connected to the speed runner R. By preference, the connecting means is in the form of some structure by which the runner may voluntarily, releasably connect himself or herself to the tow rope. In the instance depicted, the outer, free end of the tow rope is provided with a ring 50 to which a pulley 52 is connected. A short length of secondary rope 54 is looped around the pulley sheave 56 and is provided with hand grips 18 at its opposite ends. The nature of the connection at 54/56 is such that as a runner R sprints toward the post 12 while holding onto the hand grips 18 and being reeled-in by operation of the motor 22 by the operator O, the normal alternating pumping action of the runners' arms is accommodated by left-right oscillation of the secondary rope 54 along the pulley sheave 56. Thus length and tension are equalized in the hand grips 18, even though the runner's arms are pumping back and forth. The hand grips 18 may, for instance, comprise terminal loops of the secondary rope 54 on which short sections 58 of flexible rubber or plastic garden hose are received and held in place by knots 60 which are so tied as to abut opposite ends of the hose sections.

The length of the main tow rope 16 is dependent upon the length of sprint for which the runner R is training and may be, for instance, slightly longer than 100 yards or 100 meters or the like.

The apparatus 10 preferably further includes semi-automatic means for ensuring that the runner R will not be reeled into the reel 20 by mistake. In the preferred embodiment this means makes use of the usual kill switch that is conventionally provided on gasoline engine powered lawnmowers. In this instance the magneto-connected and grounded contacts 62, 64 of the kill switch are formed into rings through which the tow rope 16 passes immediately prior to the reel 20. Normally the grounded contact 64 is held by a leaf spring mount 66 in a gapped condition from the magneto-connected contact 62. However, if the grounded contact 64 is urged against the contact 62, the conventional sparking mechanism of the engine 22 will be short circuited and thus engine firing will cease. In order to cause the kill switch to be closed as the runner reaches a predetermined proximity to the reel 20, an actuator 68 is mounted on the tow rope 16. In the instance depicted, the actuator 68 is shown provided in the form of a rubber ball, e.g. of the kind conventionally used for playing the game of squash. The ball has a small diameter hole 70 bored diametrically through it so that by friction the ball will normally keep any position to which it is slid on the tow rope 16.

Accordingly, in order to train a speed runner R to sprint a distance of for instance one hundred meters, a tow rope 16 is provided that is, for instance, one hundred two meters long, the secondary rope effectively adding approximately another meter. Before the start of a practice run, the device 10 is adjusted on the post 12 so that the tow rope comes off the drum at a tangent that is level with the height at which the runner will be holding on to the free end 14 as he or she runs. The tow rope 16 is fully unwound from the reel 20 and the actuator 68 is slid forwards along the tow rope to the one hundred meter mark. The runner grasps the hand grips and gets ready to sprint. The engine 22 is started, but left to idle, so that the centrifugal clutch remains unengaged. At a conventionally-given starting signal, the operator O begins squeezing the engine throttle control, thus speeding-up the engine and engaging the clutch, and the runner R begins to sprint directly toward the post 12. Because the operator O is stationary and is not simultaneously in charge of driving a vehicle or the like, the operator may give his or her complete attention to the progress of the runner R. Thus, the operator O may gradually apply additional squeezing to the engine control throttle while observing the pace and balance of the runner and while observing the degree of tension apparent on the rope, in order to pull the runner along toward the post 12 somewhat faster than the runner would or could run the same course if unaided. This operation is an art which gets better with practice, in that the operator cannot increase the pace too drastically without causing the runner to stumble or fall or to lose his or her grip on the hand holds 18. In any event, as the runner gets to the finish line, the actuator 68 collides with the grounded contact 64 and pulls it against the magneto-connected contact 62, killing the engine 22. The extra length of the rope 16 between where the actuator ball 68 is initially placed and the pulley for the secondary rope gives room for the actuator to hold the kill switch closed long enough for the engine to die, even as the continued running and tapering-off reeling cause the actuator ball 68 to be slid along the tow rope for a few feet.

The operator may at any time during the course of the run pivot the handle 44 in the direction of the arrow 80 to apply the brake band 46 to the drum 48 of the centrifugal clutch, to slow or stop the reeling-in action provided by operation of the motor 22.

Although much of the main portion of the tow rope 16 preferably is made of somewhat resilient, elastic material so that the initial pulling force on the runner is cushioned, the terminal portion, of for instance twenty meters in length, leading to the free end preferably is made of non-stretch material, to reduce the chance that as the pulled runner nears the finish line and lets-go of the tow rope, the handles 18 will snap towards the operator O.

Figure 4:
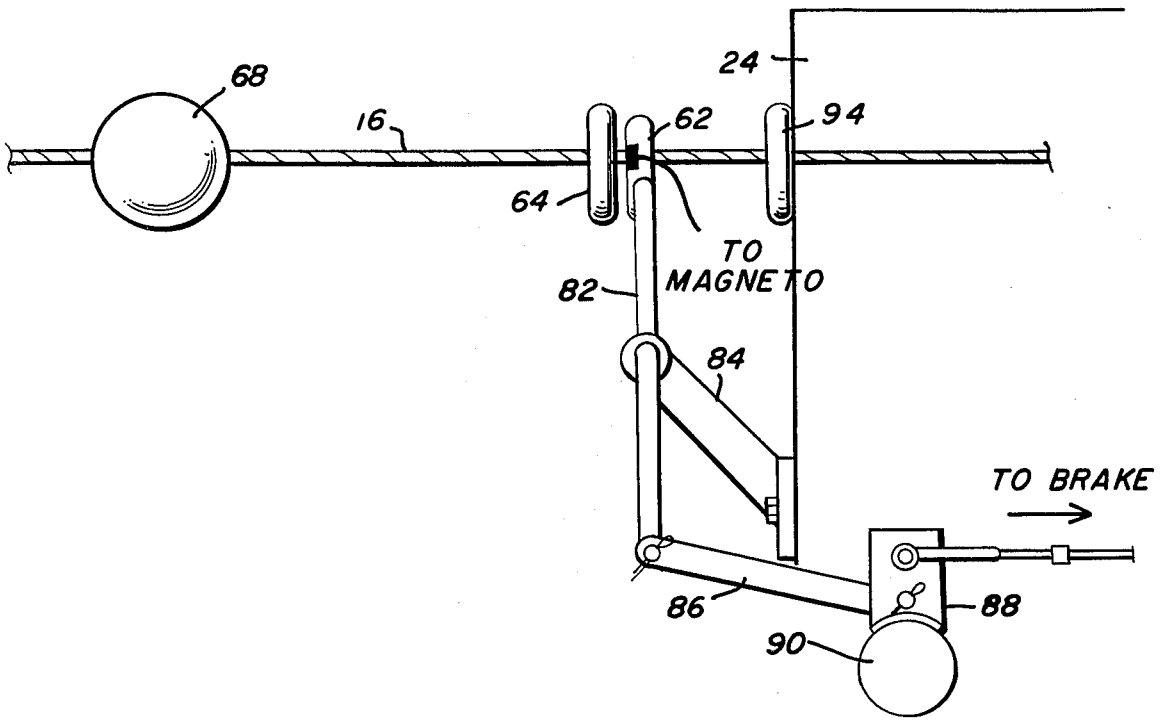
FIG. 4 is a fragmentary longitudinal vertical sectional view of a modification in which the kill switch actuator is arranged to also apply the brake.
Figure 5:
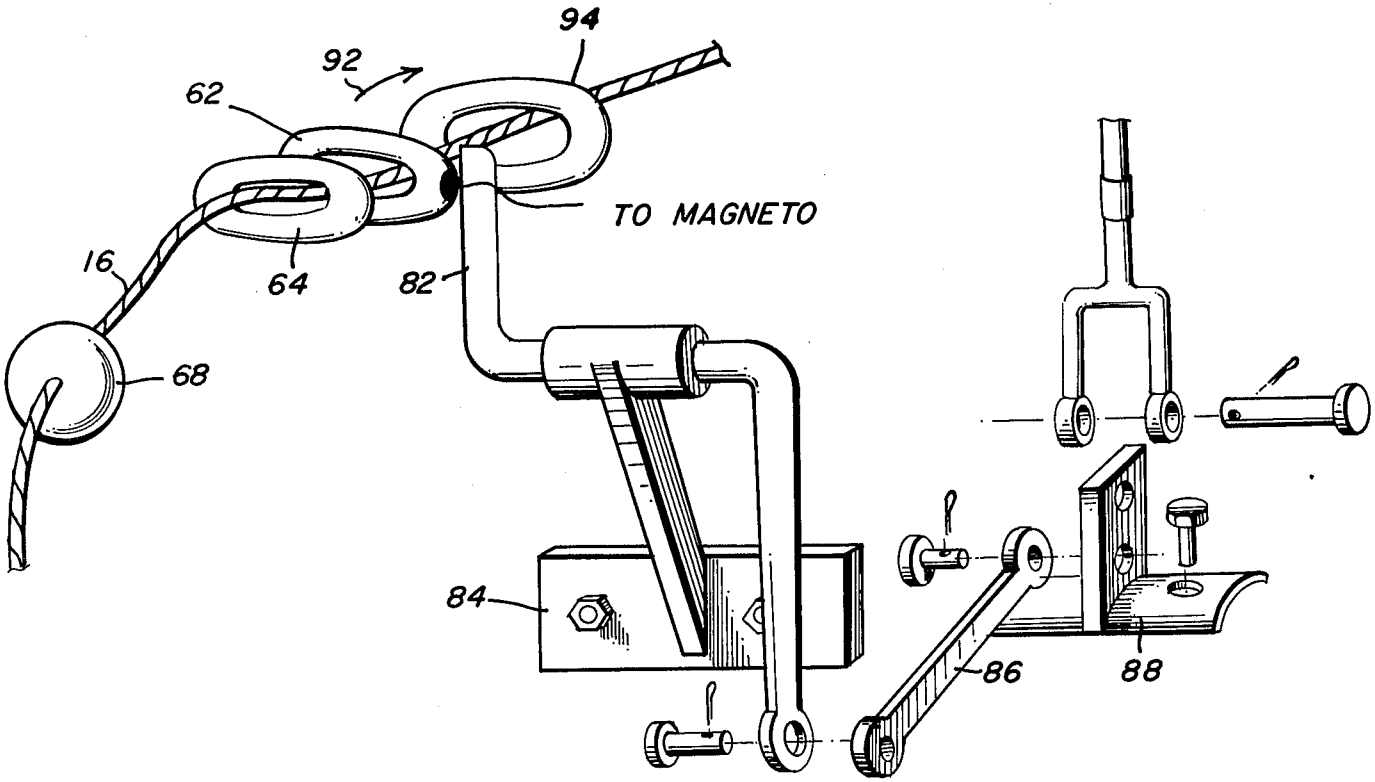
FIG. 5 is a fragmentary exploded perspective view thereof.

A presently preferred modification of the device 10 is illustrated in FIGS. 4 and 5. According to this modification, the device 10 as heretofor described is elaborated-upon to arrange the kill switch actuator 68 to automatically apply the brake 46. To that end, the magneto-connected contact 62 is mounted to one end of a crank link 82 the intermediate portion of which is pivoted to the frame 24 by a bracket 84. The other end of the crank link 82 is pivotally connected by a link 86 to the brake-connection bracket 88 on the transversally extending arm 90 of the joy stick 38. Accordingly, as the actuator 68 strikes the kill switch grounded contact 64 and deflects it against the magneto-connected contact 62, the latter, and the crank link 82 are pivoted back in the direction of the arrow 92, thus applying the brake. A stop 94 may be fixed on the frame to limit the degree of pivoting of the crank link 82. With this modification reeling-in of the runner is terminated more immediately because the brake is applied at the same time the kill switch is actuated.

Of the modifications which may be made to the apparatus and process are that the gasoline-driven engine may be replaced by one that is driven electrically, pneumatically, hydraulically or by mechanical means such as a spring or flywheel. Additional features may be provided such as a governor for preventing overzealous speeding-up by the operator O, sounding means such as a gun or bell operable by the operator from the operator's position, e.g. simultaneously with the beginning of the reeling-in step, and/or rope tension sensing and indicating means at the operator's position for indicating to the operator whether he or she may safely speed-up the reeling-in action, or should keep reeling-in at the same rate or slow it down in order to keep from overbalancing the runner.

It should now be apparent that the method and apparatus for increasing a sprinter's speed as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A method for increasing a sprinter's speed in running a course on the ground from a starting line to a finish line, said method comprising:

(a) paying out a tow line along the length of the course that is to be run by the sprinter;

(b) mounting a reeling-in mechanism at a fixed location beyond the finish line end of the course and securing one end of the tow line to the reeling-in mechanism, the reeling-in mechanism comprises a motorized reel having a kill switch past which the tow line is payed-out;

(c) frictionally sliding a kill switch actuator along the payed-out tow line toward the reeling-in mechanism to predetermine a point at which the motorized reel is to lose power;

(d) providing a secondary tow line having respective voluntary handholds mounted to two opposite ends thereof;

(e) adjustably connecting the first mentioned tow line at the opposite end thereof to said secondary tow line intermediate said handles, so that said secondary tow line is divided into two portions which may be alternatively reversibly lengthened at the expense of one another by a sprinter holding a respective one of said handholds in each hand and alternately pulling more with one hand than with the other;

(f) having the sprinter voluntarily, releasably grasp the respective handholds of said secondary rope in his or her respective hands; and (g) simultaneously, (i) starting the sprinter running along the course, and (ii) operating the reeling-in mechanism to reel-in the tow line at a speed which is at least equal to the speed at which the sprinter is running along the course and which is, during at least part of the time that the sprinter is running along the course, a speed that is faster than the maximum speed which the sprinter is then accustomed to running when unaided, so that as the sprinter runs toward the finish line and the tow rope is reeled-in if the sprinter does not voluntarily release the handholds or the power to the motorized reel is not manually cut, as the kill switch actuator engages the kill switch, power to the motorized reel is cut, preventing the runner from being drawn into the motorized reel.

2. The method of claim 1, wherein:

in performing step (b) the reeling-in mechanism is adjusted to such a height that the tow line is generally level from the reeling-in mechanism to the sprinter.

3. The method of claim 2, wherein:

the adjusting step comprises selecting a fixed support post; juxtaposing the reeling-in mechanism with the support post; and clamping the reeling-in mechanism to the support post at the requisite height.

4. Apparatus for increasing a speed runner's sprinting speed over a straight course on the ground, which course extends from a starting line to a finish line, said apparatus comprising:

a motorized reel;

means for mounting the motorized reel at a fixed location beyond the finish line;

a tow rope having one end connected to the motorized reel in a sense to be wound-in upon sustained operation of the motorized reel;

said motorized reel including a normally open kill switch;

said tow rope being arranged in juxtaposition with said kill switch;

the tow rope having an opposite end provided with means for voluntary connection of a runner thereto, this voluntary connection means comprising:

a secondary tow line having respective voluntary handholds mounted to two opposite ends thereof;

said apparatus further including a kill switch actuator in the form of an enlarged body frictionally received on said tow rope longitudinally in advance of said handholds, and adapted to engage and close said normally open kill switch upon reeling-in of a corresponding portion of said tow rope;

means adjustably connecting the first mentioned tow rope at said opposite end thereof to said secondary tow line intermediate said handles, so that said secondary tow line is divided into two portions which may be alternatively reversibly lengthened at the expense of one another by a sprinter holding a respective one of said handholds in each hand and alternately pulling more with one hand than with the the other;

so that as the motorized reel is operated in sustained operation to wind-in the tow rope, the runner voluntarily connected with the opposite end of the tow rope is drawn towards the finish line at a speed which may be faster than the maximum speed which the sprinter is then accustomed to running when unaided, so that as the sprinter runs toward the finish line and the tow rope is reeled-in if the sprinter does not voluntarily release the handholds or the power to the motorized reel is not manually cut, as the kill switch actuator engages the kill switch, power to the motorized reel is cut, preventing the runner from being drawn into the motorized reel.

5. The apparatus of claim 4, wherein:

the motorized reel comprises:

a frame; means for adjustably and removably mounting the frame to a fixed support; a reel journalled for rotation on the frame; a motor mounted on the frame; a drive train connecting the motor with the reel; and an operator's station mounted on the frame and including speed-control means for said motor.

6. The apparatus of claim 5, wherein:

the drive train includes a centrifugal clutch.

7. The apparatus of claim 6, wherein:

the operator's station further includes a brake for disengaging said centrifugal clutch and braking said reel.

8. The apparatus of claim 6, further including:

a brake constructed and arranged to be applied for disengaging said centrifugal clutch and braking said reel; and linkage means mounted to said frame and to said brake, said linkage means having a portion which is constructed and arranged to be deflected coordinately with engagement by said kill switch actuator with said normally open kill switch in a sense to apply said brake coordinately with killing said motor.

* * * * *